US005779460A

United States Patent [19]

Marz

[11] Patent Number: 5,779,460

[45] Date of Patent: Jul. 14, 1998

[54] PROGRESSIVE CAVITY PUMP WITH TAMPER-PROOF SAFETY

[75] Inventor: Horst Fritz Marz, Otterburn, Calif.

[73] Assignee: ICI Canada Inc., Canada

[21] Appl. No.: 659,901

[22] Filed: Jun. 7, 1996

[51] Int. Cl.[6] ..... F04C 2/107; F04C 5/00; F04C 13/00

[52] U.S. Cl. ..... 418/48; 418/69

[58] Field of Search ..... 418/48, 69; 417/319

[56] References Cited

U.S. PATENT DOCUMENTS

| | | | |
|---|---|---|---|
| 1,426,206 | 8/1922 | Lybeck | 417/32 |
| 2,512,765 | 6/1950 | Byram | 417/44.1 |
| 2,545,604 | 3/1951 | Byram | 418/48 |
| 2,612,845 | 10/1952 | Byram et al. | 418/48 |
| 2,778,313 | 1/1957 | Hill | 417/32 |
| 3,064,454 | 11/1962 | Sharples | 464/33 |
| 3,097,609 | 7/1963 | Nechine | 418/48 |
| 3,111,904 | 11/1963 | Burns | 415/123 |
| 3,307,486 | 3/1967 | Linberg | 418/48 |
| 3,324,801 | 6/1967 | Fernholtz | 418/48 |
| 3,930,765 | 1/1976 | Waite | 418/48 |
| 3,938,744 | 2/1976 | Allen | 418/48 |
| 4,140,444 | 2/1979 | Allen | 418/48 |
| 4,153,397 | 5/1979 | Allen | 418/48 |
| 4,500,268 | 2/1985 | Sundberg et al. | 418/69 |
| 4,639,200 | 1/1987 | Baumgardner et al. | 418/48 |
| 5,549,464 | 8/1996 | Varadan | 418/48 |
| 5,549,465 | 8/1996 | Varadan | 418/48 |
| 5,603,608 | 2/1997 | Marz | 418/48 |

FOREIGN PATENT DOCUMENTS 0255336 2/1988 European Pat. Off. .

OTHER PUBLICATIONS

"The New NM Series—Who would have thought you could improve a NEMO® Pump?"; Netzsch Product Catalog; Netsch Mohnopumpen GMBH; Waldkraiburg, Germany, Jun. 1994.

*Primary Examiner*—John J. Vrablik
*Attorney, Agent, or Firm*—Gerald A. Gowan

[57] ABSTRACT

An improved progressive cavity (pc) pump is provided. In a first aspect, the pc-pump comprises a rotor connected to a motor via a drive shaft that is isolated from the material flowing through the suction chamber of the pump, thereby preventing the pumped material from reaching the joints of the drive shaft through faulty seals. In another aspect, the pc-pump comprises a rotor assembly comprising a rotor shaft that is joined to a rotor member by means of a connecting member featuring a thermally-induced structural failure capability that provides a tamper-proof fail-safe mechanism against overheating. In a preferred embodiment the connecting member is made of low temperature melting alloy that converts into the liquid state at a temperature beyond which the operation of the pump may no longer be safe. If the pump overheats, as a result of deadhead operation or dry pumping, the connecting member melts thus terminating the driving relationship between the rotor shaft and the rotor member. The improved pc-pump is particularly useful for pumping explosives.

11 Claims, 6 Drawing Sheets

PROGRESSIVE CAVITY PUMP WITH TAMPER-PROOF SAFETY

FIELD OF THE INVENTION

The present invention relates to a progressive cavity pump with a tamper-proof safety feature. The invention also extends to a progressive cavity pump featuring an improved sealing mechanism and rotor assembly.

BACKGROUND TO THE INVENTION

Eccentric screw pumps, also known as progressive cavity pumps (pc-pumps), are widely used in the explosives industry because of their low pulsation flow, their low product shear, and their ability to handle products with up to 40% prills. They are also used in the food industry, in the handling of sewage, and in other applications where pumping of materials having relatively high abrasiveness is needed.

A typical pc-pump generally comprises a rotor mounted for rotation in a stator that defines a pumping chamber. In a typical configuration, the rotor is geometrically a large pitched helix, while the stator can be regarded as a body comprising a two-start helix with twice the pitch of the rotor. As a result, conveying spaces (cavities) are formed in the pumping chamber between the stator and the rotor.

During pumping, these cavities are filled with product and move continuously from an inlet to an outlet. Because of the smooth transition from one cavity to the next, the pump delivery is almost pulsation free. The conveying spaces are sealed by the interference between the rotor and the stator. The stator is usually made from an elastomeric material held within a rigid shell, although other configurations such as an elastomeric coated rotor can be used. The volume of the cavities during their movement remains constant. Other configurations besides a large pitched helix rotor in a two-start helix stator can be used, including, for example, a large pitch rotor of elliptical cross-section in a three-start helix stator having one and a half times the pitch of the rotor. Because of the particular rotor/stator configuration, the rotor moves radially within the stator by that defining an orbital movement. See, for example, Netzsch Product Catalog entitled "The New NM Series—Who would have thought you could improve a NEMO® Pump?", Netzsch Mohnopumpen GMBH, Waldkraiburg, Germany, June 1994.

In a typical prior art pump, the rotor is drive shaft driven. Rotary movement is imparted to the drive shaft by an electric, hydraulic, pneumatic, or other type of motor. To adapt to the orbital movement of the rotor, the drive shaft is made of a flexible material, such as spring steel, or it can be a rigid structure with universal, gear or pin joints and at its ends.

Seals or elastomeric boots are provided to prevent the pumped material, e.g., explosives, from entering the joints. Occasionally, rather than using two separate boots, an elastomeric sleeve is connected between the two joints and surrounds the shaft. Also, in certain configurations, a single boot can be used. See, for example, Waite, U.S. Pat. No. 3,930,765. Preferably, the joints are oil lubricated, in which case, the seals, boots, or sleeve, besides a keeping pumped material out of the joints, also keep the lubricant out of the pumped material.

When pc-pumps are used with explosives, they have to be guarded against excessive heat generation. During normal operation, pumped material carries heat away from the pc-pump, thus preventing the generation of excessive heat.

Excessive heat, however, can be generated in cases of deadhead operation and dry pumping.

Deadhead operation (also known as deadhead pumping) occurs when flow from the pump is blocked. This can occur at the pump's outlet or downstream from the outlet. Deadhead pumping is potentially the most dangerous condition that can exist during the pumping of explosives. If the drive motor does not stall during deadhead pumping, the total drive energy supplied to the pump will be converted into heat, that will be absorbed by the trapped explosives and by the rotor and the stator.

The rate of temperature rise depends on power input, heat sink capacity and heat dissipation of the system. When the decomposition temperature of the explosives is reached (e.g., a temperature above about 200° C. for emulsions), the entire explosive inventory within the pc-pump deflagrates, which generally results in pump destruction, physical damage to the surroundings, and serious injury to personnel who may be near the pump.

Moreover, such a primary event may lead to secondary events if fragments from the pump provide sufficient shock impetus to detonate explosives near the pump. Deadhead pumping incidents are thus a serious concern to the explosives industry and much effort has been expended to try to reduce the probability of their occurrence.

Dry pumping occurs when a pc-pump is turning but no product is available on the suction side of the stator. When a pump runs in such a dry condition, it gains heat from friction and from work derived from the deformation of the elastomer of the stator. Since no product is available to carry the heat away, it has to be absorbed by the rotor, stator, and the thin film of explosives residue that remains within the stator. As the temperature increases, the stator expands mostly inwards because of its confining rigid outer shell. This, in turn, accelerates the heating and may result in ignition of the explosives residue in the pump.

Dry pumping is generally a lesser problem than deadhead pumping because there is less explosives in the pump, but the danger is still significant. Also, dry pumping tends to occur more often. For example, operators in dealing with an air-locked pump have been known to try to solve the problem by simply continuing to run the pump, rather than taking the time to prime the pump. Operators have also been known to disable conventional safety mechanisms to allow such unsafe procedures to be used. This unfortunate truth is one reason that safety systems that are difficult to override are needed. As discussed below, the present invention overcomes such a problem.

A third dangerous condition may occur when explosives ingress the joints at the ends of the drive shaft as a result of a break in the integrity of the boot, seal, or sleeve that surrounds those joints. These joints can become less effective after long period of use because of fatigue, abrasion, chemical attack or freezing. This causes a problem since seal failure can occur without any sign detectable from the outside. Although the sliding velocities in such joints are low, the contact pressure between the metallic parts is high and this can lead to increased friction especially when the lubricant is lost and replaced by explosives. Explosives are always sensitive to friction and can become even more so through crystallization and water loss. The friction levels in a joint can thus be high enough to ignite explosives. This is dangerous and undesirable.

When non-explosive materials are being pumped, the danger of an explosion, of course, does not exist. However, presence of pumped material in the joints is not desirable since it shortens the life of the pump and can lead to contamination of the pumped material by, for example, metal particles and the lubricant.

Many approaches have been used in the prior art to address the foregoing problems. These approaches have usually been electronic in nature and have sensed no flow, high and/or low pressure, or high temperature, all of which are indicators of unsafe conditions. Devices embodying these approaches have generally been sensitive and relatively delicate. Accordingly, they have worked well in a controlled environment, but have been less fail proof in a rough environment, such as on explosives pump trucks or underground explosives loading equipment. Another drawback is that these devices have generally been too easy to bypass.

With regard to the problems associated with deadhead operation and dry pumping, one solution taught in the prior art is to provide a pump comprising a rotor member with a longitudinal cylindrical bore that receives a rotor shaft having a transverse dimension significantly less than the diameter of the bore. The clearance between the bore walls and the rotor shaft is filled with a fusible metallic binding material that constitutes a connecting member. If the temperature within the stator rises beyond the melting temperature of the alloy during the operation of the pump, the alloy softens and allows the rotor shaft to turn freely in the rotor bore (see published European patent application 0255 336). Heat build-up in the pumped material is substantially reduced since the rotor member no longer turns in the stator of the pump. This solution, however, has drawbacks. The ability of the connecting member to transmit torque to the rotor member in the normal conditions of operation depends on the bond strength bore walls/connecting member and rotor shaft/connecting member. The uniting force that links the connecting member to the associated components is due solely to the interfacial link between the binding material from which the connecting member is made and the material of the rotor member and the rotor shaft. Such interfacial link is essentially a chemical bond between compatible materials. The ability of such chemical bond to resist shearing stresses of a magnitude normally encountered during the operation of the pump is critical to avoid premature failure of the connecting member. It then follows that special and carefully executed manufacturing procedures must be followed to ensure that a bond of sufficient strength is created between the connecting member and its associated components during the manufacture of the rotor assembly. Failure to do so may result in deficient performance due to premature rupturing of the bond. In some situations, even when the manufacturing process has been carried out in a satisfactory manner, the bond may weaken over time as a result of aging, repetitive cooling/heating cycles to which the connecting member is subjected when the pump is repeatedly started and shut down, chemical changes in the materials forming the bond, etc. The bond may thus break even during the normal operation of the pump as a result of the shear stress imparted by the rotor shaft.

OBJECTS AND STATEMENT OF THE INVENTION

It is therefore an object of the present invention to provide a pump with improved safety features.

It is a further object of the present invention to provide an improved pc-pump that addresses more particularly the problems associated with deadhead operation, dry pumping and joint seal integrity.

It is yet another object of the present invention to provide a pc-pump with improved safety features that cannot be easily by-passed.

As embodied and broadly described herein, the invention provides a progressive cavity pump, comprising:

a) a casing defining a pumping chamber, the casing including:
   an inlet for admitting material to be pumped in the pumping chamber;
   an outlet for discharging pumped material from the pumping chamber;

b) a rotor mounted in the casing, the rotor being capable of rotational and orbital movements within the casing for causing displacement of material to be pumped in the pumping chamber between the inlet and the outlet;

c) a drive shaft for imparting rotary movement to the rotor;

d) a sealing mechanism for isolating the drive shaft from the pumping chamber, the sealing mechanism providing means for:
   i) accommodating a rotary movement of the drive shaft; and
   ii) accommodating an orbital movement of the drive shaft.

For the purpose of this specification the expression "orbital movement" is intended to designate a continuous path of the rotor member about some reference site that is located at some distance from the centerline of the rotor member. The path is preferably circular but it may also be elliptic or of other shape. Preferably the reference site about which the rotor moves along the continuous path is the centerline of the stator. It should be noted that the location of the reference site depends upon the geometry of the rotor/stator configuration and thus it may vary from the preferred embodiment. On the other hand, "rotational movement" is intended to designate an angular motion of a portion of the drive shaft about the centerline of that portion. For example, the drive shaft will be considered to rotate when the end portion of the shaft that connects with the rotor is subjected to an angular displacement that occurs about the centerline of the end portion, which typically, is co-incident with the centerline of the rotor.

To set apart the drive shaft structure from the rotor, the sealing mechanism will be used as reference point. All structure(s) and component(s) connected to the drive shaft and that are subject to the orbital and rotary movement and that are confined within the boundary of the pumping chamber will be considered to form part of the rotor. On the other hand, all component(s) joining with the rotor, that pass through the sealing mechanism and extend outside the pumping chamber will be considered to form part of the drive shaft.

As used in the context of the present specification, the expression "isolating" and its derivatives are used to refer to the fact that the drive shaft is separated from the pumped material. This expression should not be strictly interpreted as meaning that the drive shaft is completely sealed or that no material will ever reach or be in contact with the drive shaft or joints thereof but rather than the amount of material that contacts the drive shaft or joints thereof is negligible in terms of the type of material that is being pumped.

The progressive cavity pump in accordance with the present invention is a significant improvement over prior art devices because it is safer to operate. The location of the drive shaft outside the pumping chamber avoids accumulation of pumped material in the joints of the drive shaft, if any, that, as discussed earlier, can lead to pump deflagration when explosive substances are being processed.

In the most preferred embodiment the sealing mechanism that isolates the drive shaft from the suction chamber is a compound structure including a seal locating ring surrounding the end portion of the shaft that connects with the rotor and including two separate sealing members, one sealing member accommodating the rotary movement of the drive shaft and the other sealing member accommodating the orbital movement of the shaft. Suitable bearings are provided to locate the seal locating ring concentrically around the rotor shaft and allow the rotational movement of the rotor shaft to occur substantially without friction. Rearwardly of the bearings is mounted a lip seal that engages the surface of the drive shaft to form a barrier, preventing egress of pumped material while the drive shaft is turning.

The second sealing member, the one that accommodates the orbital movement of the drive shaft, includes a flexible annular barrier spanning the space defined between the seal locating ring and the pump casing. The structure of the annular barrier is such that the seal locating ring can be displaced relative the casing, by compression/extension of the barrier. This allows the drive shaft to orbit while preventing pumped material to egress the suction chamber on the side of the drive shaft.

In a variant, the compound seal includes a supporting ring that serves as a barrier and that is capable of rotary movement within the casing to accommodate the orbital movement of the drive shaft. Under this form of construction, the annular barrier (the supporting ring) does not need to be a compliant structure. Preferably, it is made of rigid material that is more robust than a compliant soft seal since it better resists tears and physical impacts susceptible of being encountered during the operation of the pump. It is the rotary movement of the rigid annular barrier that allows the drive shaft and the rotor member to follow an orbital path. It will be apparent that the radius of the orbital movement (distance between the orbital path and the center line of the pumping chamber) is fixed and determined by the location of the rotor with relation to the supporting ring. Objectively, this structure requires strict manufacturing tolerances by comparison to the previous embodiment using a compliant seal, because the geometry of the orbital path is fixed and only small variations are tolerable.

As embodied and broadly described herein, the invention also provides a progressive cavity pump wherein the sealing mechanism comprises a supporting ring located between the pumping chamber and the drive shaft, the supporting ring being capable of rotational movement within the casing; a first sealing member being secured eccentrically within the supporting ring, the first sealing member being concentrically located on the rotor and providing means for accommodating the rotational movement of the rotor, the pump also comprising a second sealing member secured to the casing, the second sealing member being concentrically located around the supporting ring and providing means for accommodating the rotational movement of the supporting ring, whereby:

a) the orbital movement of the rotor imparts a rotational movement to the supporting ring; and b) the second sealing member accommodates the rotational movement of the supporting ring.

In a most preferred embodiment the pump further comprises first bearing means for accommodating the rotational movement of the rotor within the supporting ring and further comprises second bearing means for accommodating the rotational movement of the supporting ring within the casing. Preferably, the first and second sealing members are lip seals and the first and second bearing means are double row ball bearings.

In another embodiment, the pump comprises means for generating a radial reaction force substantially counterbalancing a radial force generated by the rotor on the stator during pumping. This feature reduces the wear of the stator. In a preferred embodiment a bearing is provided comprising a ring concentrically mounted on the drive shaft and having a rolling surface, preferably resilient, that is continuously in contact with a portion of the casing. The bearing places a limit on the pressure that the rotor exerts against the stator, thus limiting the wear of the stator.

In another aspect the invention also provides a rotor assembly for a pump, the rotor assembly comprising:

a) a rotor member including a cavity;

b) a rotor shaft extending at least partially in the cavity;

c) a connecting member in the cavity establishing a driving relationship between the rotor shaft and the rotor member, whereby rotational movement imparted to the rotor shaft is transmitted to the rotor member by the intermediary of the connecting member;

d) the rotor member being in a condition of mesh with the connecting member;

e) the connecting member being capable of thermally-induced structural failure to terminate the driving relationship when a predetermined temperature is reached.

Also, the invention provides a progressive cavity pump, comprising:

a) a casing defining a pumping chamber, the casing including:

an inlet for admitting material to be pumped in the pumping chamber;

an outlet for discharging pumped material from the pumping chamber;

b) a rotor assembly mounted in the casing, the rotor assembly comprising:

i) a rotor member including a cavity;

ii) a rotor shaft extending at least partially in the cavity;

iii) a connecting member in the cavity establishing a driving relationship between the rotor shaft and the rotor member, whereby rotational movement imparted to the rotor shaft is transmitted to the rotor member by the intermediary of the connecting member;

iv) the rotor member being in a condition of mesh with the connecting member;

v) the connecting member being capable of thermally-induced structural failure to terminate the driving relationship when a predetermined temperature is reached.

In this specification, the expression "condition of mesh" is intended to designate an arrangement where the rotor member or the rotor shaft are mechanically interlocked with the connecting member so torque transmission occurs without relying at all or relying only partially on the bond at the surface connecting member/rotor member or connecting member/rotor shaft. For example, a mechanical interlock is achieved between the connecting member and the rotor member by providing one member with a projection received in a mating recess on the other member. In a specific example that should not be interpreted in a limiting manner, the rotor shaft includes a series of longitudinally extending projections running along the entire length of the shaft and distributed at regular angular intervals. Those projections form teeth that mechanically engage the material of the connecting member. In a similar fashion, the material of the connecting member that fills the spaces between the projections on the rotor shaft also forms teeth meshing with those projections. The engagement between the connecting member and the rotor shaft is thus similar to a spline connection. A similar spline-like connection is provided between the rotor member and the connecting member. In this example a double condition of mesh exists, namely between the rotor member and the connecting member and between the rotor shaft and the connecting member.

To create a condition of mesh between the connecting member, the rotor member or the rotor shaft, interlocking projections/recesses may be used, as described above, that do not need, however, to run the entire length of the connecting member. The projections/recesses may extend along only a portion of the connecting member length. The number and spacing of the projections/recesses can also vary without departing from the spirit of the invention. One possibility is to use a projection formed on the connecting member received in a mating recess on the rotor member and to use another projection formed on the connecting member received in a mating recess on the rotor shaft or vice versa. Another possibility to establish a condition of mesh between the connecting member and the rotor shaft is to use a rotor shaft having a non-circular cross-section at least along a portion of its length. For example a square, polygonal, triangular or an oval shaft could be used. A somewhat different possibility is to use a rotor shaft that is non-rectilinear. One section of the shaft is placed at an angle with relation to the remainder of the shaft to create a mechanical engagement with the connecting member. In a specific example the shaft may include a major longitudinally extending portion ending with a crosspiece that forms projections engaging the material of the connecting member. Another possibility that one could consider is to form the rotor shaft as a helix or, in general, a coil-shaped structure. Yet another possibility that one could consider is to provide a rotor shaft that is circular in cross-section but that is eccentrically located within the cavity of the rotor member.

The expression "thermally induced structural failure" refers to the ability of the material that forms the connecting member to loose at least partially its structural integrity so it is no longer capable of communicating rotary movement from the rotor shaft to the rotor member. In a preferred embodiment the connecting member is made of low temperature melting alloy that is converted to a liquid state when its temperature exceeds the melting point. At this stage, the rotor shaft freely turns within the pool of liquid alloy and no rotary movement is communicated to the rotor member. Preferably, the material should be eutectic or substantially eutectic. A bismuth alloy, preferably composed of 55.5% Bismuth and 44.5% Lead has been found satisfactory. Other possibilities exist. For example the connecting member may be made as a particulate structure, the particles being held in a matrix of low temperature melting alloy or, in general, a material that disintegrates or converts to the liquid phase at a given temperature. Below the given temperature the connecting member behaves as a unitary structure. When the pump overheats, however, the bond between the particles is broken and they become free to move one with relation to the other. Thus, the rotor shaft and the rotor member become disengaged from one another. One could also consider the possibility of using materials or structures to manufacture the connecting member that weaken sufficiently at a predetermined temperature to rupture the structure of the connecting member so it is no longer capable of transmitting rotary movement to the rotor member without, however, causing the connecting member to melt.

The use of low temperature melting alloy is preferred, however, because the material of the connecting member turns into a liquid that offers only a minimal resistance to the rotating shaft. It will be apparent that any significant amount of resistance offered to the rotary shaft may have the effect of continuing to drive the rotor member, which of course is undesirable.

In a preferred embodiment, the rotor assembly further comprises means for preventing contact of the rotor shaft with the rotor member upon structural failure of the connecting member and most preferably, the means for preventing contact consists of bushings located at each end of the rotor shaft.

In yet another aspect, the rotor assembly further comprises means for preventing a longitudinal displacement of the rotor member relative the rotor shaft upon structural failure of the connecting member and preferably, the means for preventing the longitudinal displacement of the rotor member consists of a ball located in the cavity of the rotor member.

Other objects and features of the invention will become apparent by reference to the following specification and to the drawings.

BRIEF DESCRIPTION OF THE DRAWINGS

The following is a description by way of a preferred embodiment, reference being made to the following drawings, in which.

DESCRIPTION OF A PREFERRED EMBODIMENT

Figure 1:
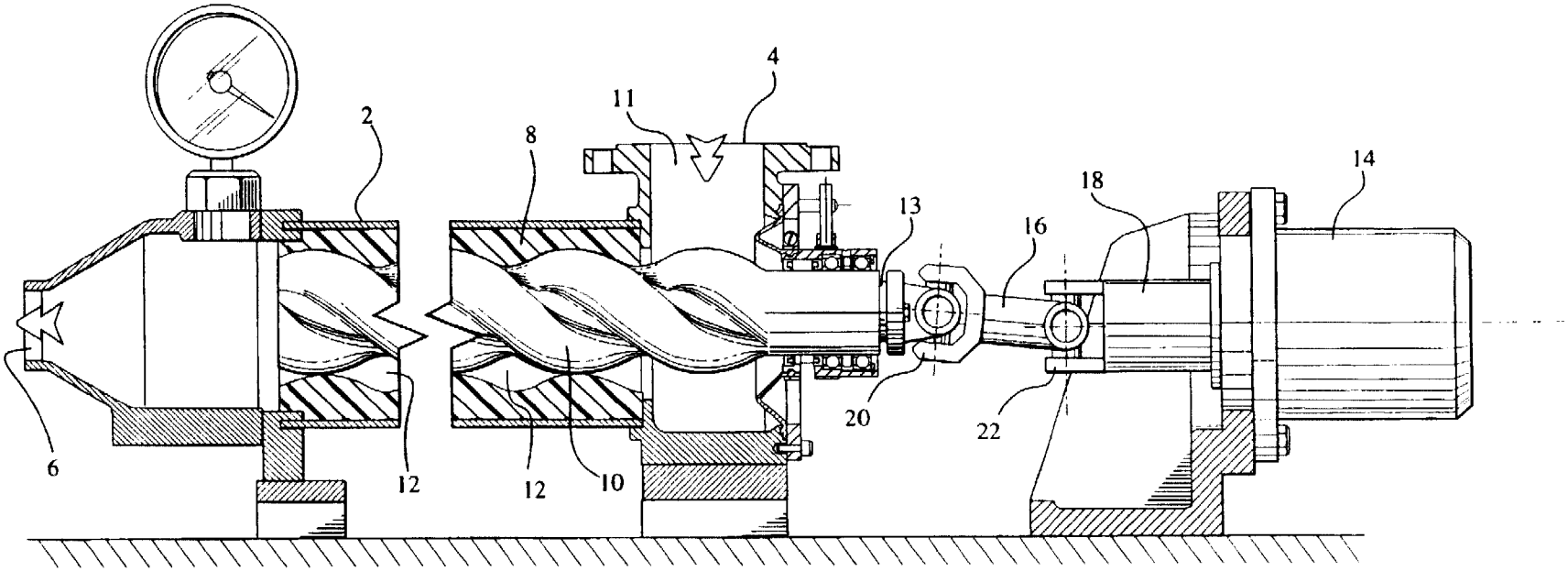
FIG. 1 is a vertical longitudinal cross-sectional view of the pc-pump with improved safety features according to a first aspect of the present invention.

Referring now to FIG. 1, the pc-pump according to the present invention is particularly useful for pumping explosives and comprises a casing 2 having an inlet 4 and an outlet 6. The casing also comprises a stator 8 for receiving a helical rotor 10. The stator defines a pumping chamber that includes a suction chamber 11 formed downstream of the inlet 4, in the direction of travel of the pumped material, and conveying spaces, such as space 12, defined in the recesses between the stator 8 and the rotor 10. These conveying spaces are sealed by the interference between the rotor and the stator. During pumping, these conveying spaces are filled with pumped material and move continuously with a smooth transition which results in providing a pump having an operation that is almost pulsation free.

The rotor/stator configurations that can be used include a large pitched helix rotor in a two-start helix stator having twice the pitch of the rotor (referred to as a ½ geometry) or a large pitch rotor of elliptical cross-section in a three-start helix stator having three times the pitch of the rotor (referred to as a ⅔ geometry). Because of the particular rotor/stator configuration, the rotor follows an orbital path within the stator, around the centre axis of the stator (illustrated by the dotted line B in FIG. 4). The rotor in a pc-pump with a ½ geometry completes one orbit per rotor revolution and the orbital movement in a pc-pump with a ⅔ mgeometry is two orbits per rotor revolution. Other rotor/stator configuration may also be used.

The stator may be of the full elastomer type or of the uniform wall thickness type. The full elastomer stator comprises a steel tube with a cast elastomeric lining having the desired shape. The uniform wall thickness stator comprises an outside casing in the desired shape lined with an elastomer having the same thickness throughout, the thickness depending upon the size of the pump. Since the liner is the same thickness throughout the pump, it exerts a uniform pressure over the entire line of contact. Both types of stators are well known and available from various manufacturers. The person skilled in the art will also recognize that other types of stators may be used that fall within the scope of the present invention.

The helical rotor 10 can be made of any suitable material such as stainless steel or aluminum with a hard coated surface, aluminum being preferred because of its heat dissipation properties. For the reasons herein detailed, it is important for the rotor to possess good thermal conductivity to provide an overall fast response to an excessive heat generation inside the pump due to a deadhead operation or to dry pumping. Good heat dissipation properties are also important to avoid the formation of so-called "hot spots", that are caused by excessive friction between the rotor and the stator at a particular area as a result of imperfections on the surface of the rotor or stator.

The rotor 10 comprises a shaft 13. The rotor 10 and the shaft 13 may consist of a single machined component or may consist of two separate elements connected to one another as explained in greater details hereinafter.

The rotor 10 is connected to a motor 14 using a compound drive shaft that may comprise a first shaft 18 and a second shaft 16. The motor may be electric, hydraulic, pneumatic or of any other type. The rotor 10 is connected to the drive shaft in any conventional manner. If desired, the rotor 10 and the drive shaft may be connected using a unidirectional locking arrangement that will disengage if the motor is inadvertently driven in reverse direction, thereby preventing any risk of creating a situation that may result in an accident.

Located at each end of the second shaft 16 are joints 20 and 22. These joints are required to allow the motor 14 to exert on the rotor the required torque while accommodating its orbital movement. Joints 20 and 22 may be preferably universal joints but can also be of any other type such as gear, pin or homokenetic joints.

Contrary to conventional pc-pumps in which the drive shaft is located within the pumping chamber, the drive shaft of the of the pc-pump of the present invention is isolated from the pumping chamber. This is achieved by the particular sealing mechanism described in more details in FIGS. 2, 3 and 4.

Figure 2:
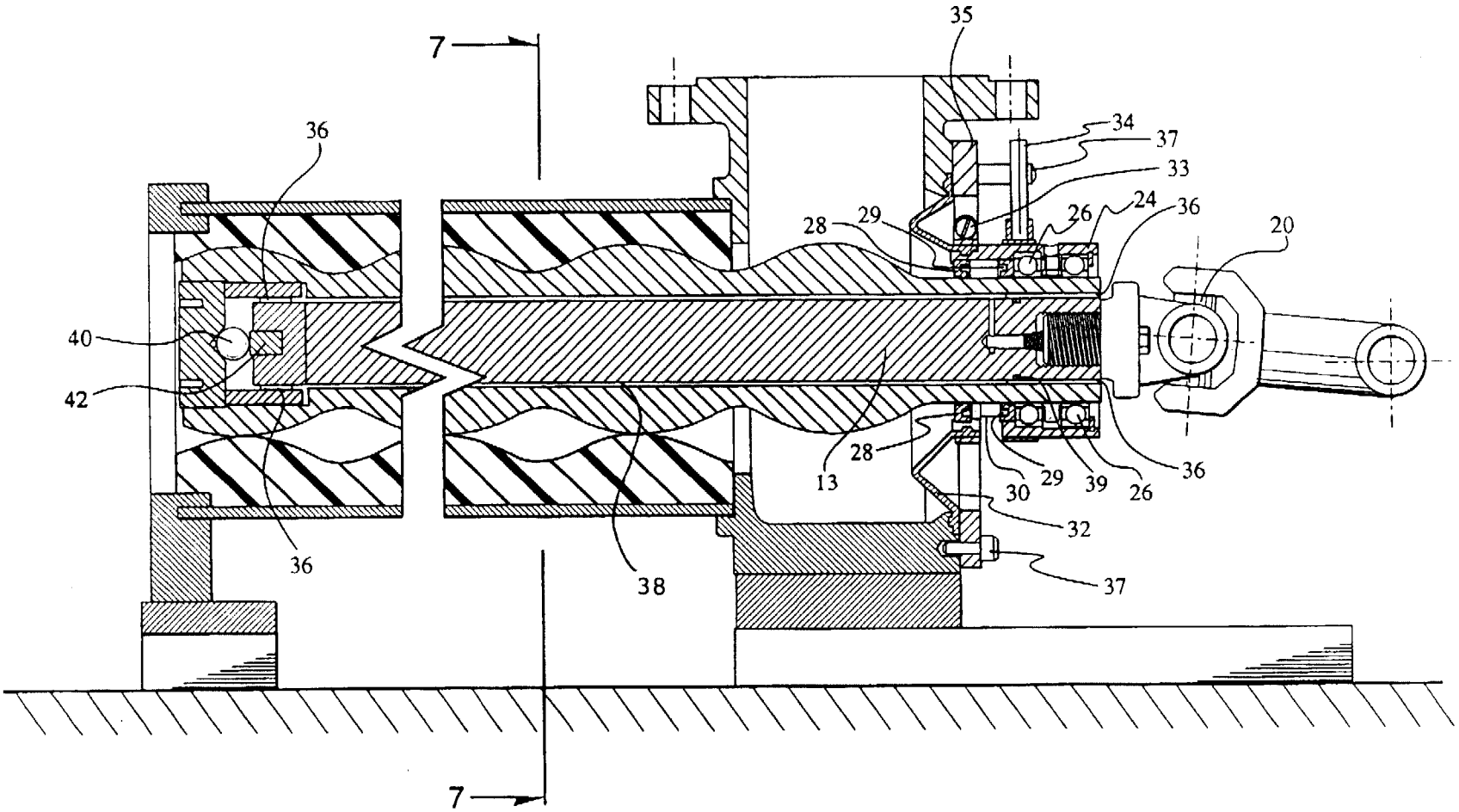
FIG. 2 is a vertical longitudinal cross-sectional view of a pc-pump according to the present invention detailing a first embodiment of the sealing mechanism and the improved rotor assembly.

A first embodiment of the sealing mechanism according to the invention will now be described with reference to FIG. 2. According to this first embodiment, a seal locating ring 24 is provided at the first end of the rotor shaft, adjacent joint 20. Suitable bearings, such as ball bearings 26, are used to mount the seal locating ring 24 on the rotor and to accommodate the rotational movement of the rotor. The bearings 26 may comprise, for example, a metal ball inside a race made of plastics material or a plastics ball inside a metal race. The use of plastics is recommended since the pumped material may be corrosive and attack metal. The seal locating ring itself does not rotate but follows the orbital movement of the rotor, as it will be explained hereinafter.

The seal locating ring 24 includes a first sealing member consisting of two lip seals 28 and 29. The lip seals 28 and 29 bear against the surface of the rotor 10 and allow the rotor to turn within the seal locating ring while forming a barrier to prevent egress of pumped material from the suction chamber 11 of the pump that forms a constituent part of the pumping chamber. If, for any reasons, pumped material passes beyond the lip seal 28, it will egress the seal locating ring 24 through radial relief slot 30 and will thus not reach the bearings 26 or the joint 20. Other types of seals could also be used provided they allow the rotor to rotate within the seal locating ring while preventing pumped material from ingressing it.

The outside of the seal locating ring 24 is isolated from the suction chamber by means of a second sealing member comprising a pleated flexible annular barrier spanning the space between the seal locating ring 24 and the casing. The seal locating ring does not rotate within the flexible barrier and the latter accommodates the orbital movement of the rotor and of the seal locating ring by compression/extension. The second sealing member thus permits the seal locating ring 24 to follow the orbital movement of the rotor shaft while isolating the drive shaft from the suction chamber 11.

For typical explosives applications, the second sealing member must be able to support a negative head of an approximately 9 metres water column and a positive head of an approximately 10 metres water column and accept radial flexing of up to ±8 millimetres. A type of seal that may be used as second sealing member in the present invention is illustrated in FIG. 2 and consists of an elastomeric ring 32 having a V-shaped cross-section, the inner perimeter being secured to the seal locating ring 24 by means of a suitable clamp 33 and the outer perimeter being secured to the casing 2 of the pump by a suitable retaining ring 35 and screws 37.

To prevent the seal locating ring 24 from rotating within the second sealing member because of the friction between the rotor shaft 13 and the seals 28 and 29, there may be provided a hollow torque arm 34 that positively locks the seal locating ring 24 against rotation. The torque arm includes an elongated slot (not shown in the drawings) that slidingly receives the screw 37. During the orbital movement of the seal locating ring 24, the torque arm 34 slides over the screw 37 to authorize the orbital movement while preventing the seal locating ring from turning. Such a torque arm may however not be necessary if the friction between the rotor shaft 13 and the lip seal 28 is minimal.

Figure 3:
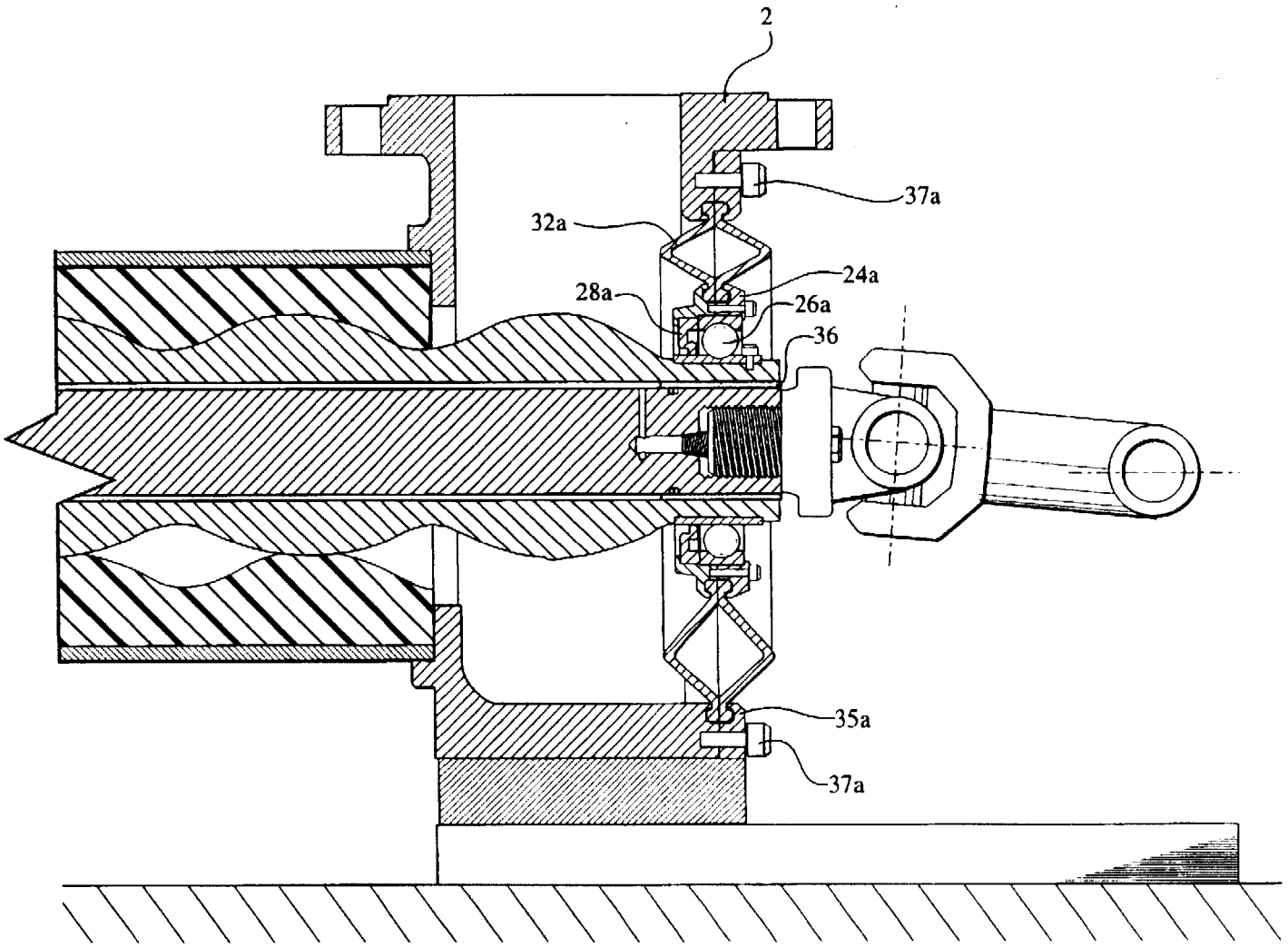
FIG. 3 is a vertical longitudinal cross-sectional view of a pc-pump according to a first aspect of the present invention detailing a second embodiment of the sealing mechanism.

Referring now to FIG. 3, there is shown a second embodiment of the sealing mechanism according to the invention. This second embodiment features a more compact seal design allowing to reduce the longitudinal dimension of the pump. In this second embodiment, the first and second sealing members are similar to the first and second sealing members of the first embodiment and consist respectively of a suitable lip seal 28*a* and flexible annular barrier comprising a elastomeric ring 32*a* secured to the seal locating ring 24*a* and to the casing 2 by a suitable retaining ring 35*a* and screws 37*a*. In this particular embodiment, the ball bearing 26*a* is located in close proximity with the first sealing member (lip seal 28*a*) thereby allowing the provision of a seal locating ring 24*a* that is shorter than the seal locating ring 24 of the first embodiment. The seal locating ring of the second embodiment does not however comprise a radial relief slot to allow any pumped material that passes beyond the lip seal 28*a* to be evacuated. It is thus preferable to provide bearings 26*a* that do not have any metal to metal contact for the reasons mentioned hereinbefore and also to provide bearings that do not have an outer lip seal so as to permit any pumped material passing lip seal 28*a* and reaching the bearing 26*a* to pass through it without being trapped.

A third embodiment of the sealing mechanism will now be described with reference to FIGS. 4, 5 and 5*a*. This particular sealing mechanism generally referred to at 50 has the advantage of integrating the first sealing member that accommodates the rotational movement of the rotor and second sealing member that accommodates the orbital movement of the rotor in a single unit.

In accordance with this embodiment, there is provided a first sealing member including a lip seal 60 that is press fitted to the interior of a supporting ring 54, the lip seal 60 being concentrically located around the rotor (FIG. 5) and accommodating the rotor's rotational movement. Contrary to the first and second embodiments, the supporting ring does not need to be a compliant structure and is preferably rigid. As shown more particularly in FIG. 5, the supporting ring 54 is shaped in such a manner that the first sealing member 60 is eccentrically located within the supporting ring 54. More particularly, the supporting ring 54 is shaped so that the first sealing member 60 will follow exactly the orbital movement of the rotor shaft 13 around the centre axis of the stator (referred at B in FIGS. 4 and 5). Lip seal 60 thus prevents pumped material from ingressing the space between the rotor and the supporting ring 54.

There is also provided a second sealing member consisting of a lip seal 62 that is press fitted to the interior of the casing 2, the lip seal 62 being concentrically located around the supporting ring 54 and accommodating the supporting ring's rotational movement as explained below. Lip seal 62 prevents pumped material from ingressing the space between the supporting ring 54 and the casing 2.

To facilitate the rotational movements of the rotor shaft 13 and of the supporting ring 54, there are provided suitable bearings. A first double row ball bearing 52 is secured to the interior of supporting ring 54, adjacent lip seal to accommodate the rotational movement of the rotor shaft 13. Similarly, a second double row ball bearing 56 is secured to the interior of the casing 2 and accommodates the rotational movement of the supporting ring 54. First and second bearings 52 and 56 are isolated from the suction chamber by first and second sealing members 60 and 62 respectively.

During the operation of the pump, since the rotor shaft 13 is free to rotate within the first sealing member 60 and first bearing means 52 and since the supporting ring 54 is free to rotate within the second sealing member 62 and the second bearing means 56, the orbital movement of the rotor shaft 13 will impart a rotational movement to the supporting ring 54 (see FIG. 5a) with the consequence that the sealing mechanism will accommodate both the rotational and orbital movements of the rotor shaft while isolating the drive shaft from the suction chamber.

While this third embodiment has been described using double row ball bearings, it may be possible to use other types of bearing such a single ball bearings or double or single roller bearings. In another embodiment (not shown), there could also be provided an additional row of lip seals adjacent lip seals 60 and 62 and a passageway between the two rows of seals to allow any pumped material passing beyond the first row of seals to egress the sealing mechanism without reaching the second row of seals (like the first embodiment illustrated in FIG. 2).

Since any pumped material that may pass beyond lip seals 60 and 62 will reach the bearings 52 and 56, it is preferable in this third embodiment to provide bearings that do not have any metal to metal contact for the reasons mentioned hereinbefore. Similarly, it is preferable for these bearings not to comprise any integrated seals to prevent the material from being trapped inside the bearings. Any material that passes beyond the bearings will egress the pump through radial slot 30' and will not reach the drive shaft.

The inventor has realized that locating the joints of the pc-pump outside the suction chamber may, sometimes, result in a premature wear of the stator, particularly in the area adjacent the suction chamber (defined for the purpose of the present specification as the "stator inlet") and especially in the case of elastomeric stators. Without intent to be bound by any particular theory, it is believed that this premature wear is the result of excessive radial force applied by the rotor against the stator, particularly in the area of the suction chamber 11. Indeed, the pressure of the material at the pump outlet creates a force on the rotor tending to displace the rotor toward the right, as seen in FIG. 4, for example. This force is counterbalanced by an opposing force acting on the rotor and generated by the drive shaft. Because of the angular relationship between the rotor and the drive shaft, this opposing force possesses a horizontal component and a radial component. The radial component of this force leads to increased pressure at the rotor/stator interface, particularly in the area of the stator inlet, which may result in an accelerated wear of the stator.

The importance of the radial component of the opposing force will depend upon the angle of the drive shaft relative to the longitudinal axis of the rotor and upon the distance between the stator inlet and the first joint of the drive shaft. Generally, a greater angle or distance will result in a more important radial component. To prevent premature wear of the stator inlet, the user is faced with two choices. The first solution, commonly implemented in the prior art, is to locate the joint as close as possible to the stator inlet. This solution however has the drawbacks discussed hereinbefore. A second possibility is to provide a long drive shaft, to reduce the angle drive shaft/rotor. While this solution permits to isolate the drive shaft from the suction chamber, it has the disadvantage of increasing the longitudinal dimension of the pc-pump.

Figure 4:
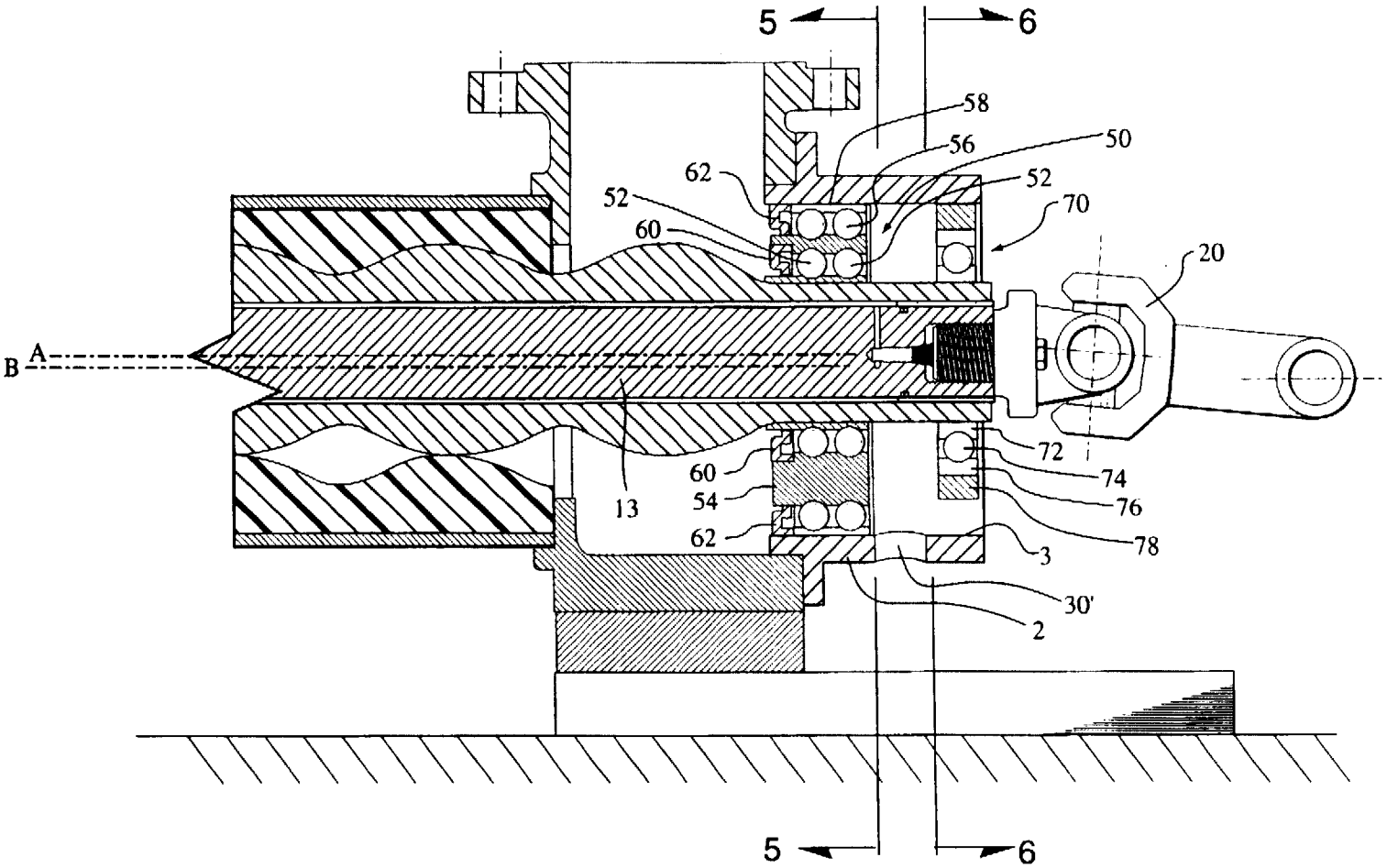
FIG. 4 is a vertical longitudinal cross-sectional view of the a pc-pump according to a first aspect of the present invention detailing a third embodiment of the sealing mechanism and also detailing the shaft supporting roller.
Figure 5:
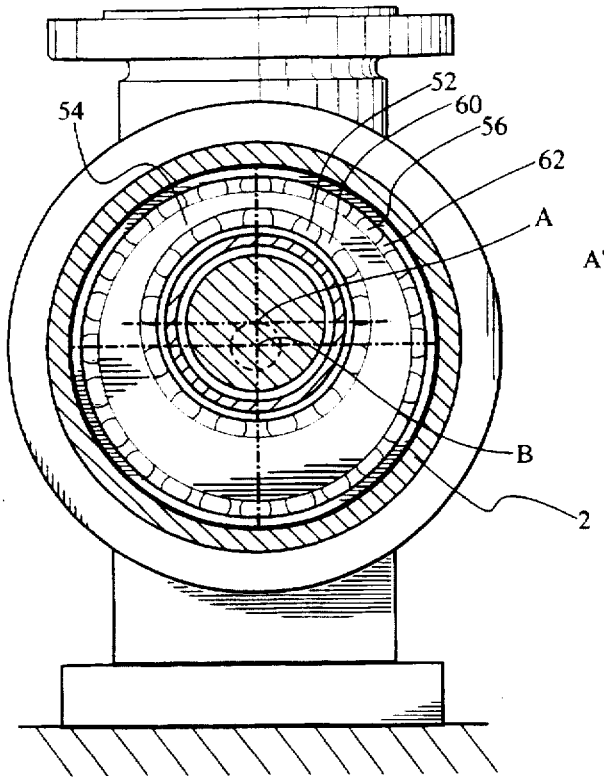
FIG. 5 is a cross sectional view taken along lines 5—5 of FIG. 4 showing a third embodiment of the sealing mechanism.
Figure 5A:
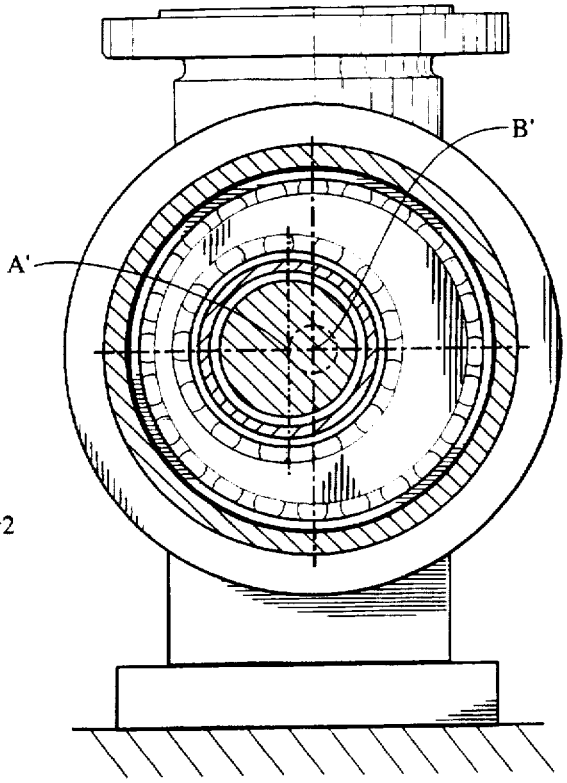
FIG. 5*a* is a cross sectional view similar to FIG. 5 illustrating the supporting ring in a different angular position.
Figure 6:
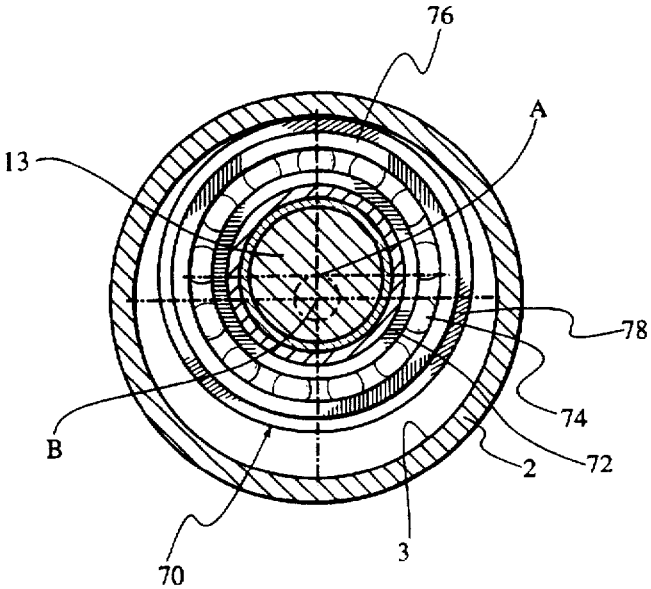
FIG. 6 is a cross sectional view taken along lines 6—6 of FIG. 4 showing the shaft supporting bearing.

As shown in FIGS. 4 and 6, to prevent premature wear of the stator inlet in a pc-pump having a drive shaft isolated from the suction chamber, there is provided a bearing that will allow the radial component of the force to be taken up by the casing of the pump, rather than acting on the elastomeric coating of the stator.

As shown more particularly in FIG. 4, the bearing 70 is located between the sealing mechanism and the joint 20. The bearing 70 comprises an inner race 72 secured to the rotor shaft 13, an outer race 76 that will continuously contact the interior of the casing 2 so that the radial component of the force will be taken up by the casing 2 instead of the stator inlet, and balls or rollers 74 between the two races to reduce friction. As a result of the orbital movement of the rotor, the outer race 76 of bearing 70 will roll against the inside cylindrical surface 3 of the casing that will generate, in turn, a reaction force nullifying the radial component that acts on the rotor.

In a preferred embodiment, the outer race 76 of the bearing may be provided with a resilient sheath 78 to compensate for any misalignment between the center axis of the stator (dotted line B) and the center axis of the casing within which the bearing 70 will roll or to compensate for any small deformation of the casing. Such a resilient surface also reduces noise and eliminates the need for lubrication.

In another aspect of the invention, the pc-pump comprises an improved rotor assembly designed to cease rotating automatically when a predetermined temperature is reached, to avoid heat build-up. This rotor assembly constitutes an improvement over the rotors currently found in the prior art and particularly over the rotor assembly described in published European patent application 0 255 336 referred to earlier and that uses a fusible metallic binding material to create a bond between the rotor shaft and the rotor member.

More particularly, the inventor has discovered that the problem associated with the breakage of the bond between the shaft and the rotor can be avoided by providing a connecting member between the rotor shaft and the rotor member that relies upon a mechanical engagement (condition of mesh) with the rotor member, or the rotor member and the rotor shaft to effect torque transmission. In a preferred embodiment, described in association with FIGS. 2 and 7, the improved rotor assembly comprises a rotor member 10 comprising a longitudinally extending cylindrical cavity. A rotor shaft 13 having a first end adjacent joint 20 and a second end adjacent the output end of the pump, and having a diameter that is smaller than the diameter of the cavity of the rotor member is located therein. Plastic bushings 36, that prevent the rotor shaft from contacting the rotor member when the connecting member changes from the solid state to the liquid state as explained below, are also placed near the first and second ends of the rotor shaft. The surface of the rotor shaft 13 defines with the interior wall of the rotor member 10 a space 38 (see FIG. 7).

Figure 7:
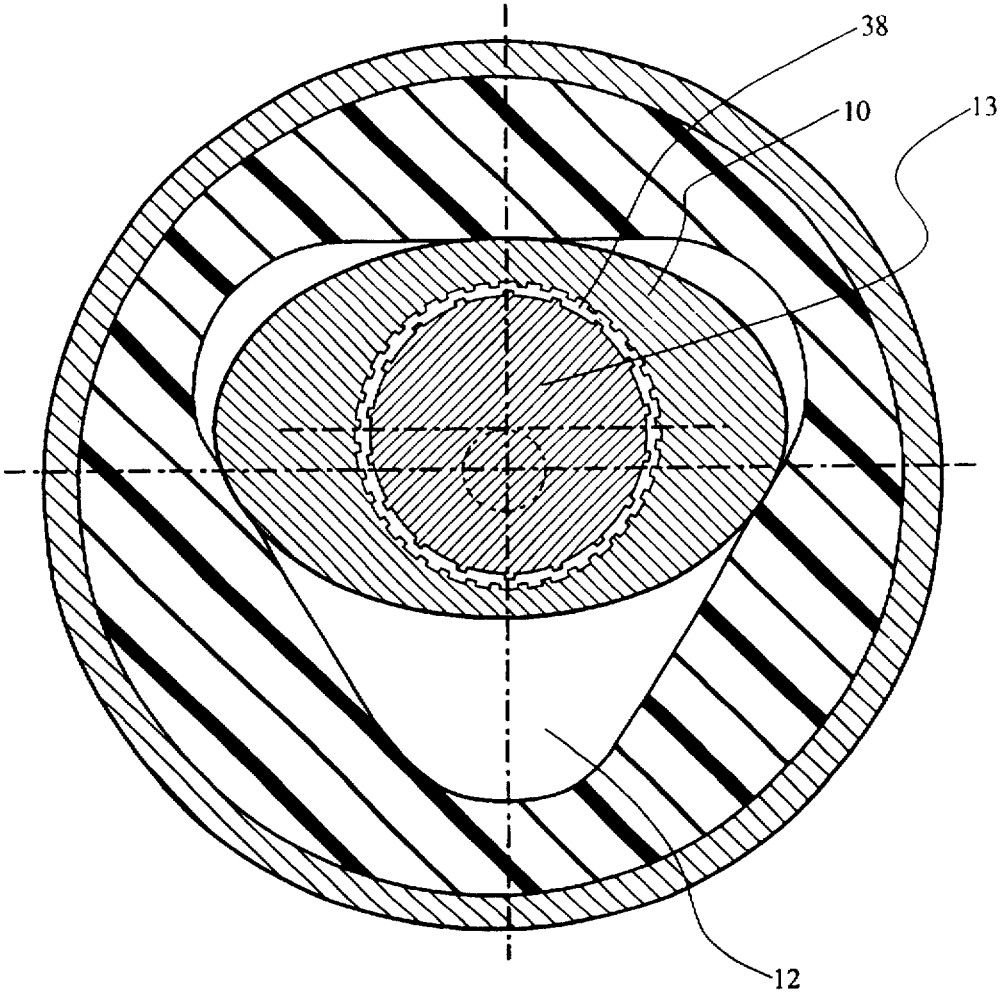
FIG. 7 is a cross sectional view taken along lines 7—7 of FIG. 2 showing a rotor assembly according to another aspect of the present invention.

As shown more particularly in FIG. 7, the interior surface of rotor member 10 and the surface of the rotor shaft 13 comprise longitudinal protrusions and recesses alternating with one another. The space 38 when filled with a suitable material that forms the connecting member, will allow both the rotor member and the rotor shaft to be in a condition of mesh with the connecting member. More specifically, the material from which the connecting member is to be made is liquefied and poured to fill the space. Upon solidification of the material, the connecting member will be created and will establish a driving relationship between the rotor shaft 13 and the rotor member 10 without relying on surface adhesion only, as discussed in the introductory part of this specification.

The predetermined melting temperature of the material forming the connecting member will be chosen in accordance with the nature of the pumped material. In the case of explosives, the melting temperature of the material (and of the connecting member) will be from about 20° C. to about 40° C. above the maximum pumping temperature (i.e., the highest temperature normally reached inside the pump) but well below the decomposition temperature of the explosive that, as previously mentioned, is about 200° C. for emulsions. The maximum pumping temperature for non-cap sensitive explosives is generally around 80° C. while it is generally around 95° C. for cap sensitive explosives. The desired melting temperature is obtained by selecting a suitable eutectic or near eutectic material alloys. A preferred alloy for explosive applications consists of a mixture of 55.50% Bi and 44.50% Pb and has a melting temperature of 124° C. Such an alloy is available from The Canada Metal Company Limited and is commercialised under the trade mark CERROBASE (number 5550-1). This alloy also possesses sufficient creep strength to support the shearing stress imparted by the rotor shaft on the material which has been estimated at approximately 50 psi in the case of a pump having a ⅔ geometry. The person skilled in the art will however recognize that other material capable of thermallyinduced structural failure will be available, provided they possess the required creep strength.

If, as a result of a deadhead operation or dry pumping, the temperature inside the pump raises, the temperature of the rotor member will also raise and the heat will be transmitted to the connecting member. When the melting temperature of the material is reached, the connecting member will melt and as a result, the driving relationship between the rotor shaft 13 and the rotor member 10 will terminate. The rotor shaft will thus turn freely in the bushings 36 without imparting any motion to the rotor member and no significant amount of heat will be generated by the rotor member 10. This will prevent the explosives that are located inside the pump from acquiring more heat thereby avoiding a possible deflagration. Suitable seal 39, located adjacent bushing 36, is provided to prevent the melted material from egressing the space 38 or to prevent pumped material from ingressing same.

The interior surface of the rotor member and the surface of the rotor shaft allow for the provision of a connecting member that is in a condition of mesh with the rotor shaft and with the rotor member. Thus, the connection between the rotor shaft 13 and the rotor member 10 of the rotor assembly does not depend on adhesion but rather depends on a connection whose strength depends on the creep strength of the material forming the connecting member. "creep" being understood as meaning a change of shape or deformation due to a prolonged exposure to stress. Although the rotor assembly of present invention does not exclude the formation of a bond, it does not rely on it.

Regarding the creep strength requirement, the material forming the connecting member should possess sufficient creep strength for the connecting member to support the shearing stress imparted by the rotor shaft to the material during normal operating conditions. As previously mentioned, the shearing stress imparted by the rotor shaft of a pump having a ⅔ geometry is approximately 50 psi and the material should support such a stress at the pumping temperature. Care must thus be taken to ascertain that the material can support the stress at the pumping temperature, and not only at room temperature. Suitable materials having the required creep strength and melting temperature can be chosen by routine testing from the person skilled in the art. Similarly, since the size of the protrusions or recesses allowing the connecting member to establish a driving relationship between the rotor shaft and the rotor member, will also vary depending upon the creep strength of the material, routine testing may also be required to determine the proper size.

In a preferred embodiment, a rotor shaft having a diameter of 50 mm was provided with teeth approximately 2,5 mm deep while the interior surface of the rotor member was also provided with teeth approximately 2,5 mm deep. The clearance between the rotor shaft and the rotor member was approximately 2 mm and the cavity was filled with CERROBASE (number 55501-1).

Once the connecting member has melted, the residual pumping pressure acting on the rotor face at the outlet of the pump, may cause a longitudinal displacement of the rotor member 10 relative to the rotor shaft 13. If such displacement occurs, the frictional force exerted by the tip of the rotor shaft on the bottom of the cavity of the rotor member that receives the rotor shaft could generate enough friction to impart a rotational movement to the rotor member. To prevent such longitudinal displacement of the rotor member and the consequent undesirable driving engagement, there is provided a hardened ball 40 inside the cavity of the rotor member, between the rotor member and the second end of the rotor shaft (see FIG. 2). If the connecting member is liquefied, the ball, in addition to preventing the longitudinal displacement of the rotor member reduces the frictional force exerted by the second end of the rotor shaft and allows the rotor shaft 13 to turn freely inside the rotor member. In a preferred embodiment, the end of the rotor shaft 13 may be provided with a hardened insert 42 to prevent the shaft from wearing-out at the contact area of the rotor shaft and the ball 40. Other devices, such as a thrust bearing located between the rotor member 10 and the joint 20 or between the rotor member 10 and the first end of the rotor shaft, could serve the same purpose.

If desired, the pump could be equipped with a sensing device that would prompt the motor to stop upon a disengagement of the rotor member.

The above description of a preferred embodiment should not be interpreted in any limiting manner since variations and refinements are possible which are within the spirit and scope of the present invention. The scope of the invention is defined in the appended claims and their equivalents.

The Embodiments of the Invention In Which an exclusive Property or privilege is claimed are defined as follows:

1. A rotor assembly for a pump, said rotor assembly comprising:

a) a rotor member including a cavity;

b) a rotor shaft extending at least partially in said cavity;

c) a connecting member in said cavity in contact with said rotor member and said rotor shaft and thereby establishing a driving relationship between said rotor shaft and said rotor member so that rotational movement imparted to said rotor shaft is transmitted to said rotor member by the intermediary of said connecting member and therefor wherein said rotor member is in a condition of mesh with said connecting member; and wherein d) said connecting member is capable of thermally-induced structural failure prior to sheer-induced failure to terminate said driving relationship when a predetermined pump temperature is reached.

2. A rotor assembly as defined in claim 1, wherein said connecting member is in a condition of mesh with said rotor shaft.

3. A progressive cavity pump, comprising:

a) a casing defining a pumping chamber, said casing including;

an inlet for admitting material to be pumped in said pumping chamber;

an outlet for discharging pumped material from said pumping chamber;

b) a rotor assembly mounted in said casing, said rotor assembly comprising:

i) a rotor member including a cavity;

ii) a rotor shaft extending at least partially in said cavity;

iii) a connecting member in said cavity in contact with said rotor member and said rotor shaft and thereby establishing a driving relationship between said rotor shaft and said rotor member so that rotational movement imparted to said rotor shaft is transmitted to said rotor member by the intermediary of said connecting member whereby rotor member is in a condition of mesh with said connecting member; and wherein iv) said connecting member is capable of thermally-induced structural failure prior to sheer-induced failure to terminate said driving relationship when a predetermined pump temperature is reached.

4. A progressive cavity pump as defined in claim 3, wherein said connecting member is in condition of mesh with said rotor shaft.

5. A progressive cavity pump as defined in claim 4, wherein said connecting member converts to a liquid state when said predetermined temperature is reached.

6. A progressive cavity pump as defined in claim 4, wherein said rotor assembly further comprises means for preventing contact of said rotor shaft with said rotor member when said connecting member converts to a liquid state.

7. A progressive cavity pump as defined in claim 6, wherein said means for preventing contact of said rotor shaft with said rotor member includes bushings located at each end of said rotor shaft.

8. A progressive cavity pump as defined in claim 5, wherein said connecting member is made of a bismuth alloy.

9. A progressive cavity pump as defined in claim 8, wherein said alloy is composed of 55.5% Bismuth and 44.5% Lead.

10. A progressive cavity pump as defined in claim 5, wherein said rotor assembly further comprises means for preventing a longitudinal displacement of said rotor member relative said rotor shaft when said connecting member is liquefied.

11. A progressive cavity pump comprising:

a) a casing defining a pumping chamber, said casing including;

an inlet for admitting material to be pumped in said pumping chamber;

an outlet for discharging pumped material from said pumping chamber;

b) a rotor assembly mounted in said casing, said rotor assembly comprising:

i) a rotor member including a cavity;

ii) a rotor shaft extending at least partially in said cavity;

iii) a connecting member in said cavity in contact with said rotor member and said rotor shaft and thereby establishing a driving relationship between said rotor shaft and said rotor member so that rotational movement imparted to said rotor shaft is transmitted to said rotor member by the intermediary of said connecting member, whereby said rotor member is in a condition of mesh with said connecting member; and wherein iv) said connecting member is capable of thermally-induced structural failure and converts to a liquid state in order to terminate said driving relationship when a predetermined pump temperature is reached and further, wherein said rotor assembly further comprises means for preventing a longitudinal displacement of said rotor member relative to said rotor shaft when said connecting member is liquefied, and, wherein said means for preventing the longitudinal displacement of said rotor includes a ball located in said cavity of said rotor member adjacent a tip of said rotor shaft.

* * * * *